US008251343B2

(12) United States Patent
Zhang

(10) Patent No.: US 8,251,343 B2
(45) Date of Patent: Aug. 28, 2012

(54) TOOL HANGER

(75) Inventor: Yu Jun Zhang, Shanghai (CN)

(73) Assignee: Meridian International Co., Ltd., Centennial, CO (US)

( * ) Notice: Subject to any disclaimer, the term of this patent is extended or adjusted under 35 U.S.C. 154(b) by 819 days.

(21) Appl. No.: 12/274,503

(22) Filed: Nov. 20, 2008

(65) Prior Publication Data

US 2009/0134298 A1 May 28, 2009

(30) Foreign Application Priority Data

Nov. 23, 2007 (CN) ..... 2007 2 0075908 U

(51) Int. Cl.
*A47G 29/00* (2006.01)

(52) U.S. Cl. ..... 248/691; 206/349; 211/70.6; 248/314

(58) Field of Classification Search ..... 248/682, 248/691, 309.1, 314, 316.1; 211/66, 69, 211/70.6; 206/736, 349, 376
See application file for complete search history.

(56) References Cited

U.S. PATENT DOCUMENTS 4,450,961 A * 5/1984 Bies et al. ..... 206/349
5,044,591 A * 9/1991 Huang ..... 248/317
5,996,817 A * 12/1999 Kao ..... 211/70.6
6,193,200 B1 * 2/2001 Kao ..... 248/309.1
6,241,092 B1 * 6/2001 Vasudeva ..... 206/349
6,241,208 B1 * 6/2001 Lin ..... 248/309.1
6,315,119 B1 * 11/2001 Lee ..... 206/349
6,375,005 B1 * 4/2002 McCann ..... 206/349
6,464,840 B1 * 10/2002 McCann ..... 206/349
6,732,989 B1 * 5/2004 Kao ..... 248/309.1
6,834,767 B1 * 12/2004 Lin ..... 211/70.6
6,935,516 B2 * 8/2005 Chiang ..... 211/70.6
7,210,663 B2 * 5/2007 Wheeler et ..... 248/309.1
7,264,213 B2 * 9/2007 Liu ..... 248/309.1
7,287,644 B2 * 10/2007 Chen ..... 206/378
7,527,150 B2 * 5/2009 Tong ..... 206/376
7,648,029 B2 * 1/2010 Chen ..... 206/376
2002/0175257 A1 * 11/2002 Yen ..... 248/309.1
2003/0034316 A1 * 2/2003 Kao ..... 211/70.6
2003/0141266 A1 * 7/2003 Lin ..... 211/70.6
2003/0213760 A1 * 11/2003 Lee ..... 211/70.6
2005/0067307 A1 * 3/2005 Kao ..... 206/349
2005/0116130 A1 * 6/2005 Hu ..... 248/309.1
2006/0091091 A1 * 5/2006 Tuan Mu ..... 211/70.6
2007/0102381 A1 * 5/2007 Nguy et al. ..... 211/70.6
2007/0102382 A1 * 5/2007 Tuan Mu ..... 211/70.6
2008/0179265 A1 * 7/2008 Lin ..... 211/70.6

* cited by examiner

*Primary Examiner* — Bradley Duckworth
(74) *Attorney, Agent, or Firm* — Jason R. Sytsma; Shuttleworth & Ingersoll, PLC

(57) ABSTRACT

A device for holding and displaying hand tools, especially for exhibiting such products in a retail establishment. The hanger consists of a bracket having a slot for hanging the device on a hook, peg, etc. The bracket is connected to a connecting member that has a tool holder. The bracket can be disconnected from the tool holder by a snap fastener which also allows the bracket to be pivoted downwardly behind the connecting member for compact storage and shipping. The snap fastener also allows for different types and sizes of tool holders to be connected to the bracket, depending upon the tool being displayed.

16 Claims, 8 Drawing Sheets

TOOL HANGER

PRIORITY CLAIM

The present application claims priority under 35 USC 119 to Chinese Patent Application No. 2007-20075908.4.1 filed on Nov. 23, 2007, the entire contents of which application is hereby incorporated by reference.

FIELD OF THE INVENTION

The novel hanger of tools relates to devices used for storing and exhibiting hand tools and the like, especially for displaying such tools or other products at the point of sale.

BACKGROUND THE INVENTION

There are numerous kinds and type of devices, both general and specialized, for hanging small objects, such as hand tools, for storage by the user or for display at the point of sale or for display by vendors at trade shows, for example. Many of these hangers are of a very simple structure, typically in one piece, and are inexpensive to manufacture. However, when multiple tools are displayed in a single location at a trade show or by a retailer, the simple hangers of the prior art have many disadvantages. For example, one type of hanger may be suitable for only one type of tool, therefore requiring multiple, different hangers for the different tools. Thus, the user must maintain a variety of hangers, none of which are standard. Also, having multiple non-standard hangers renders a display of multiple tools somewhat unappealing. Moreover, the hangers of the prior art have no place for product identification, price, etc. Also, many of these simple hangers when shipped, will tangle and make it inconvenient to unpack when the hangers are used.

DESCRIPTION OF THE PREFERRED EMBODIMENTS OF THE INVENTION

Figure 1:
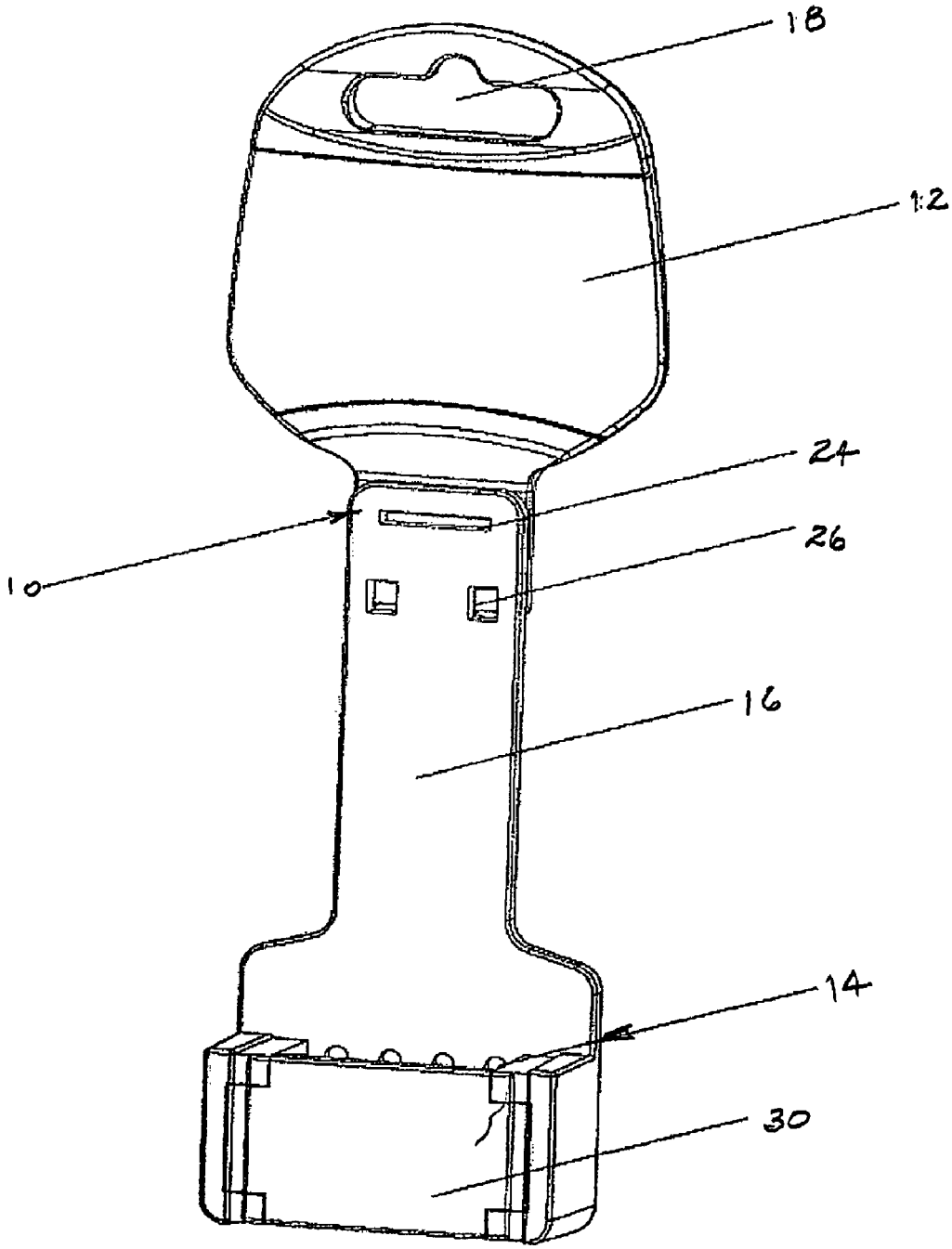
FIG. 1 is a perspective view of the front of the hanger of the invention.
Figure 2:
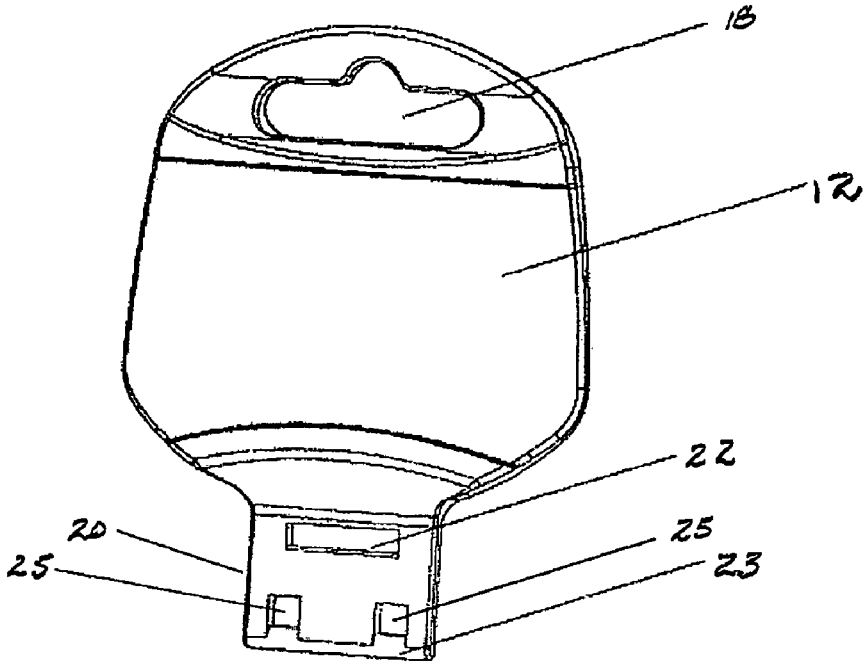
FIGS. 2 and 3 are a view similar to FIG. 1 but showing the bracket detached from the tool holder and showing the front panel of the tool holder removed.
Figure 3:
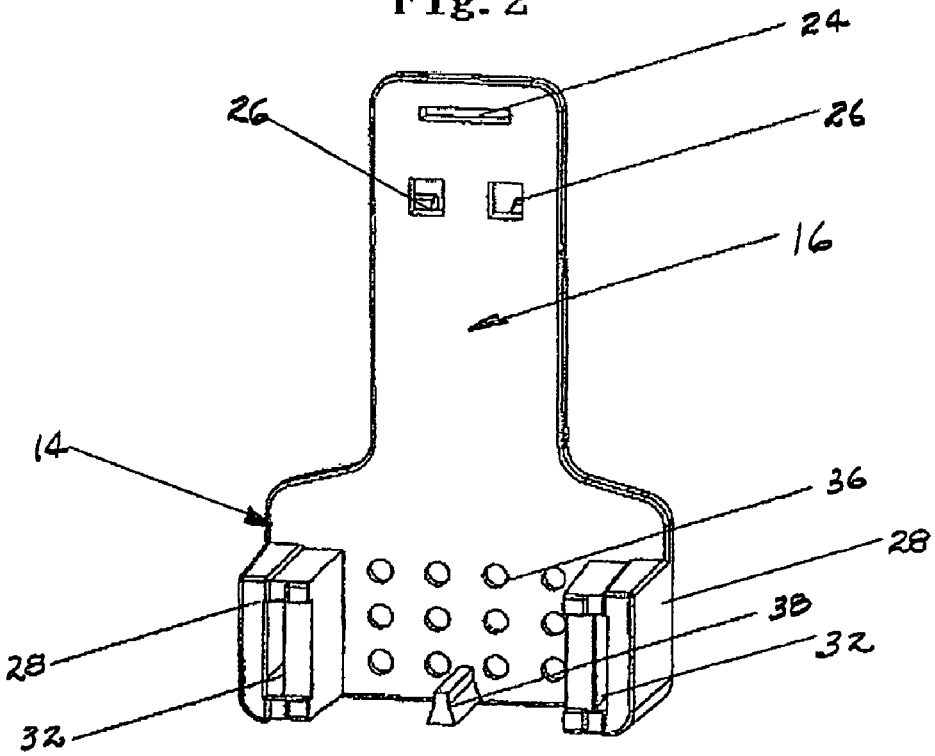
Figure 4:
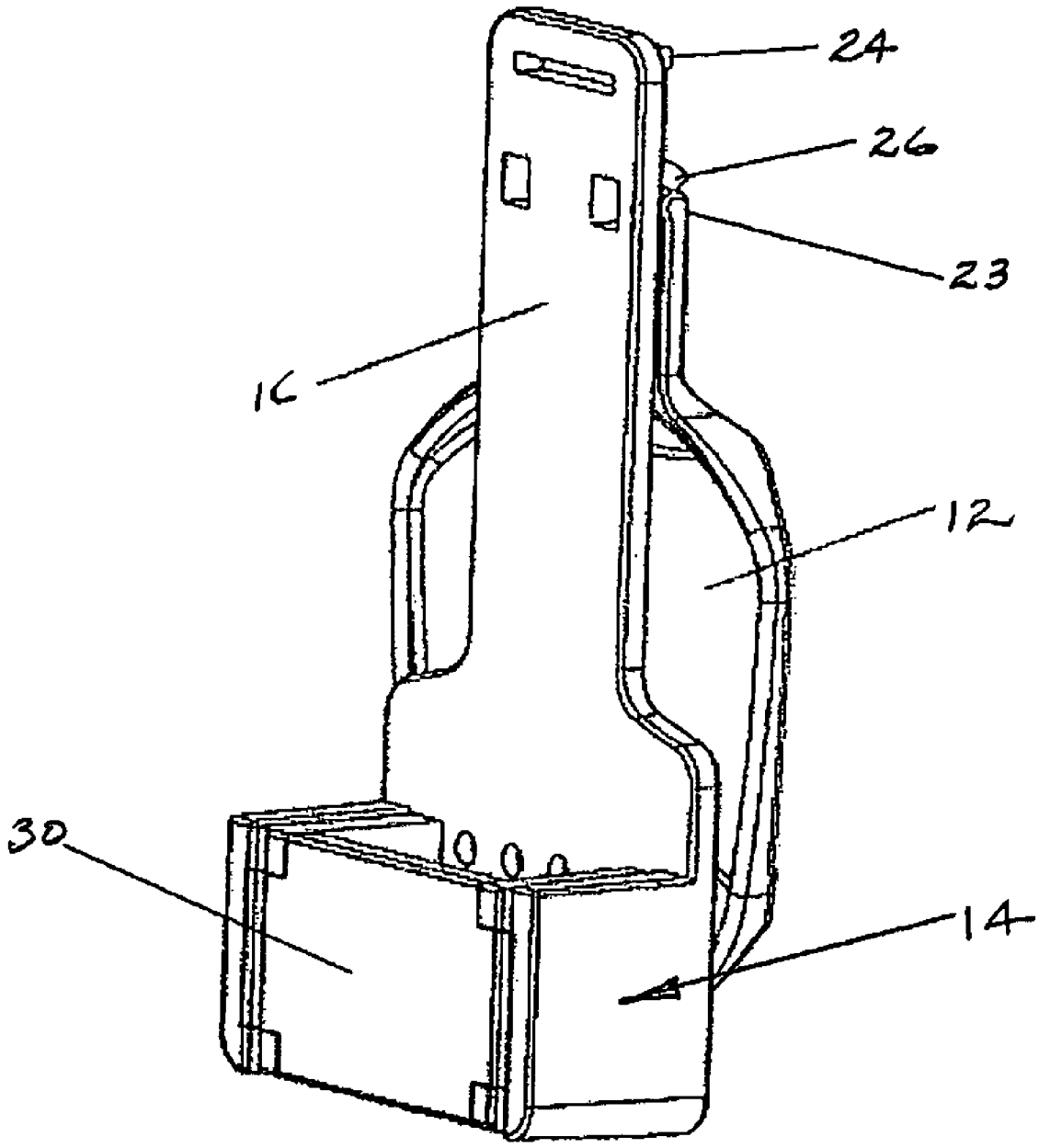
FIG. 4 is a perspective view of the front of the hanger and showing the bracket folded down for compact storage.
Figure 5:
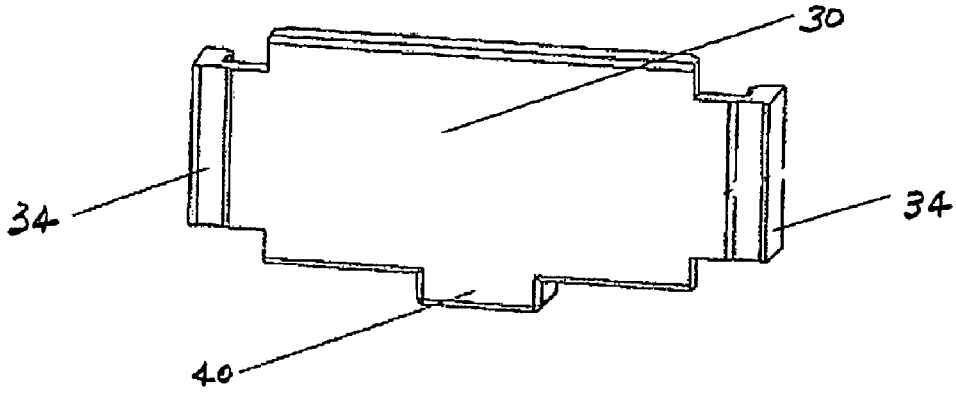
FIG. 5 is a perspective frontal view of the removable panel of the tool holder;.
Figure 6:
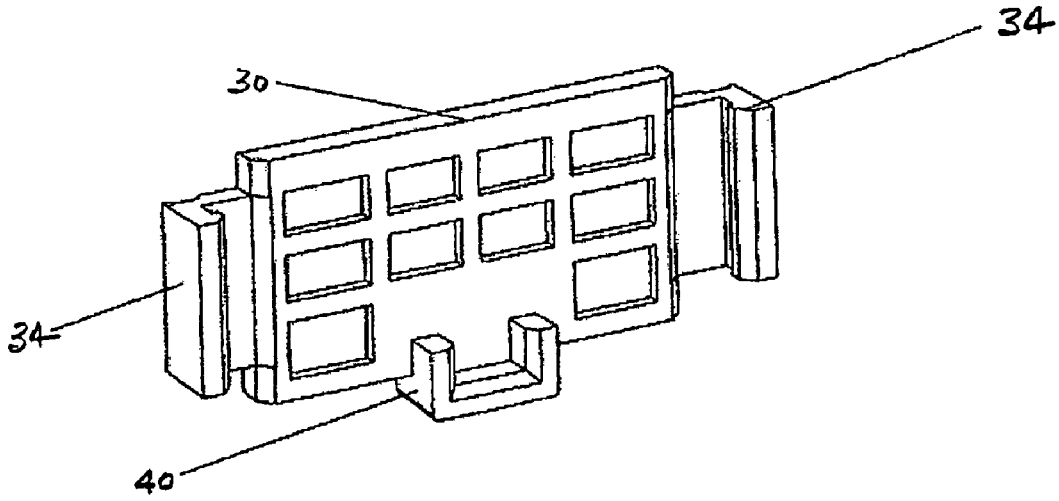
FIG. 6 is a perspective rear view of tool holder panel of FIG. 5.
Figure 7:
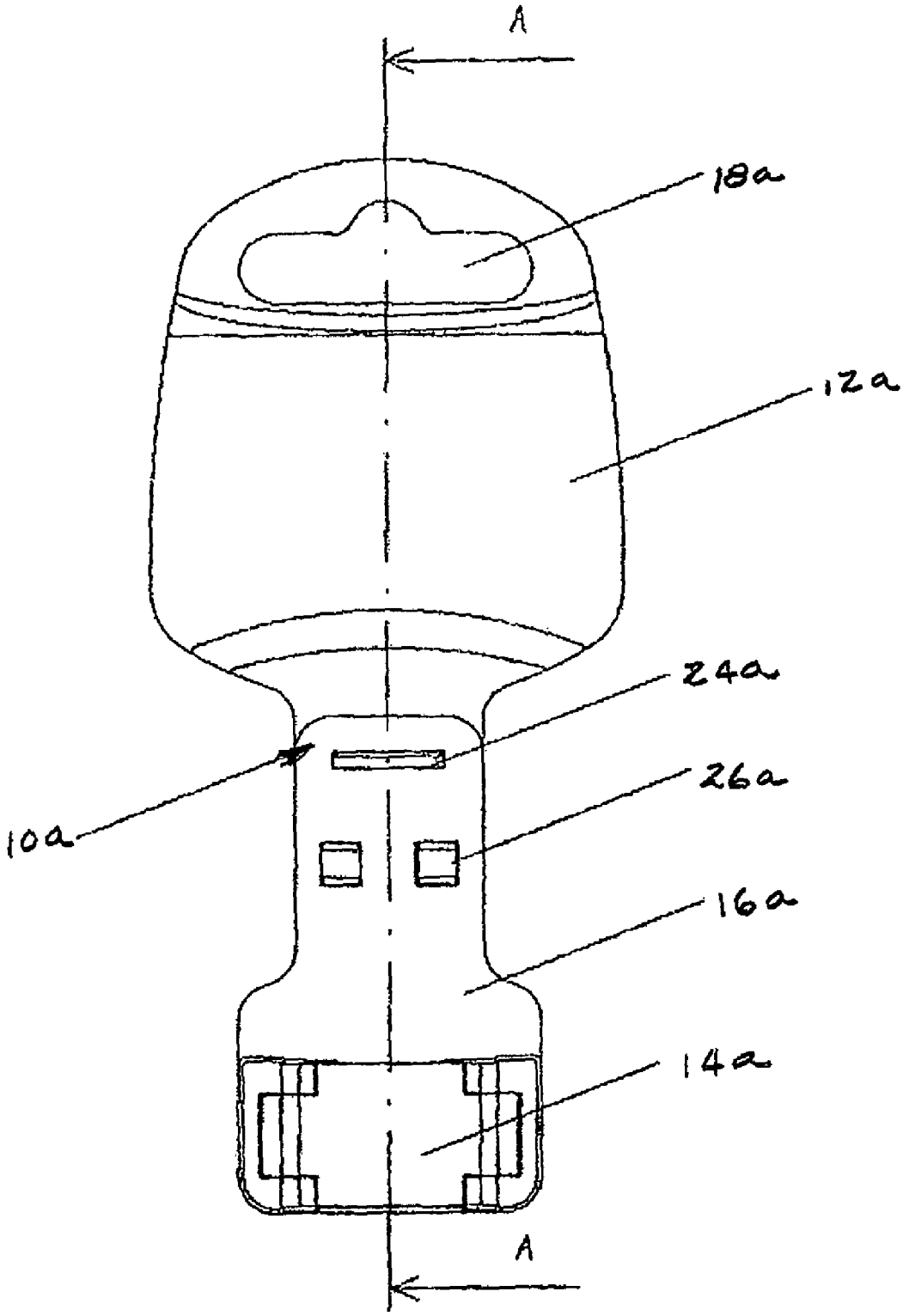
FIG. 7 is a front elevational view of a second embodiment of the novel hanger.

Referring first to FIGS. 1-6, the hanger of the invention is indicated generally by the reference number 10 and consists of a bracket 12 removably connected to a tool holder 14 that is formed integrally with a connecting member 16 that provides for connection of the bracket to the tool holder 14. The bracket 12 has a slot 18 near its upper end which slot 18 is used for hanging the device on a suitable hanger such as a hook or peg (not shown). The bracket 12 also has near its bottom end 20 a snap orifice 22 (FIG. 2), and the bottom end 20 of the bracket 12 is rounded to form a shaft 23. The connecting member 16 and tool holder 14 are preferably formed into a single piece by any suitable method, such as injection molded slot and tab. The upper end of the connecting member 16 has a snap button 24 that is engageable with the snap orifice 22 of the bracket 12 to removably connect them together. The snap button 24 on the connecting member 16 snaps into the snap orifice 22 in the bracket 12 to hold the bracket 12 in place on the connecting member 16 when the hanger 10 is in use. The connecting member 16 also has projecting from its rear surface two vertically spaced apart pairs of snap fasteners 26 which receive and engage between the pairs the shaft 23 of the bracket 12 to hold the bracket 12 connected to the connecting member 16 while allowing the bracket 12 to pivot downwardly around the shaft 23 until the bracket 12 lays against the rear surface of the connecting member 16. The folded condition of the hanger 10 is shown in FIG. 4. This makes the hanger 10 more compact for storage and shipping. In order to accommodate the bracket 12 in its upright or non folded condition, the upper pair of snap fasteners 26 will engage in orifices 25 formed in the lower end 20 just above the shaft 23 while the snap fastener 24 snaps into the snap orifice 22 to hold the bracket 12 and connecting member 16 together.

In the first embodiment of FIGS. 1-6, the connecting member 16 has a relatively simple tool holder 14. It should be understood, and it will be more evident from the description of the second embodiment of FIGS. 7-13, that the bracket 12 can be connected to different versions of tool holders so that the hanger 10 can be adapted for hanging and displaying a wide variety of tools, including but not limited to pliers of various types, screw drivers of different sizes, vise grips, metal shears, etc. This ability to connect the bracket 12 to different tool holders is provided by the snap and pivot construction at the lower end 20 of the bracket 12 and at the upper end of the connecting member 16.

As illustrated in FIGS. 1-6, the tool holder 14 formed at the bottom of connecting member 16 is comprised of two spaced-apart, parallel side panels 28 formed as a part of the connecting member 16 at its lower end and a removable panel 30. The side panels 28 extend outwardly, and each has formed at its outer edge a snap orifice 32 that is adapted to receive the corresponding snap fastener 34 of the removable panel 30 (FIGS. 4 and 5) that forms a part of the tool holder 14. (see FIG. 5). The area on the back wall of the tool holder 14 behind the removable panel 30 is shown as having a plurality of small openings 36 suitable for flexible, bendable ties (not shown) that can be used to temporarily secure certain tools in the holder 14. In the embodiment of FIGS. 1-6, the tool holder 14 is shown as being provided with a divider block 38 (FIG. 3) extending outwardly between the side panels 28. The divider block 38 is affixed to or formed as a part of the back wall of the tool holder 14. Divider block 38 mates with a support block 40 secured to or formed as a part of the inside wall of the removable panel 30. This arrangement is for holding certain types of tools such as pliers and similar tools, the divider block 38 and support block 40 separating the legs of the pliers just below where the jaws of the pliers are pivoted. It should be understood that some versions of the tool holder 14 will not have the blocks 38, 40 since they are not necessary to hold some tools.

Figure 8:
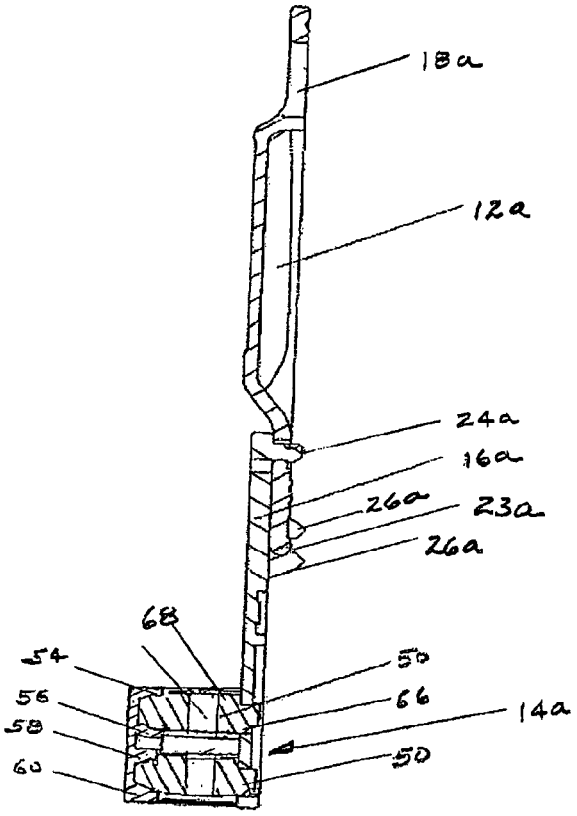
FIG. 8 is a sectional view of the hanger taken on the line A-A of FIG. 7.
Figure 9:
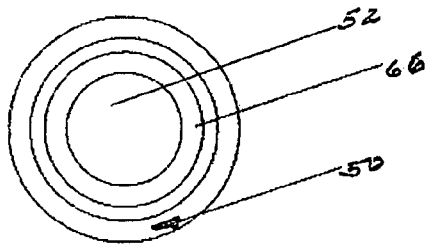
FIG. 9 is a bottom view of a rubber ring used in the tool holder.
Figure 10:
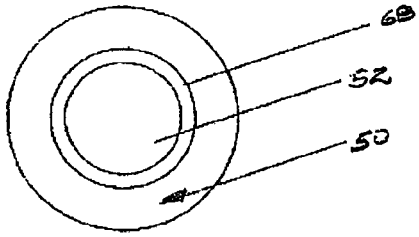
FIG. 10 is a top view of the rubber ring of FIG. 9.
Figure 11:
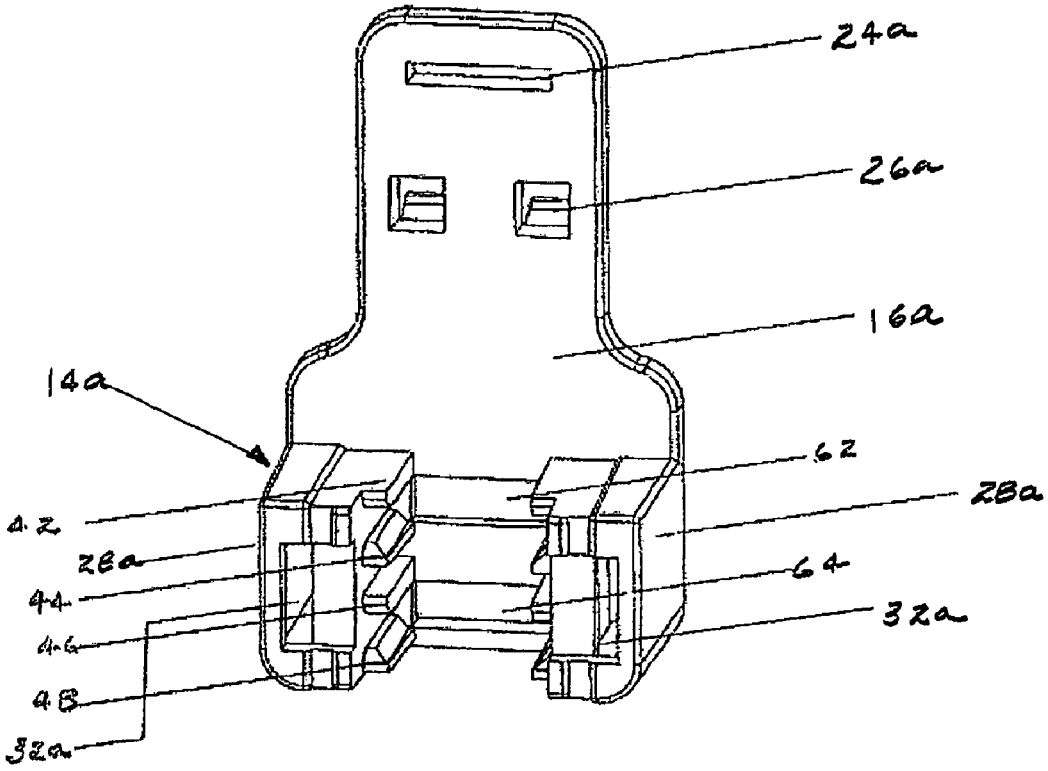
FIG. 11 is a perspective view of the tool holder of the second embodiment.
Figure 12:
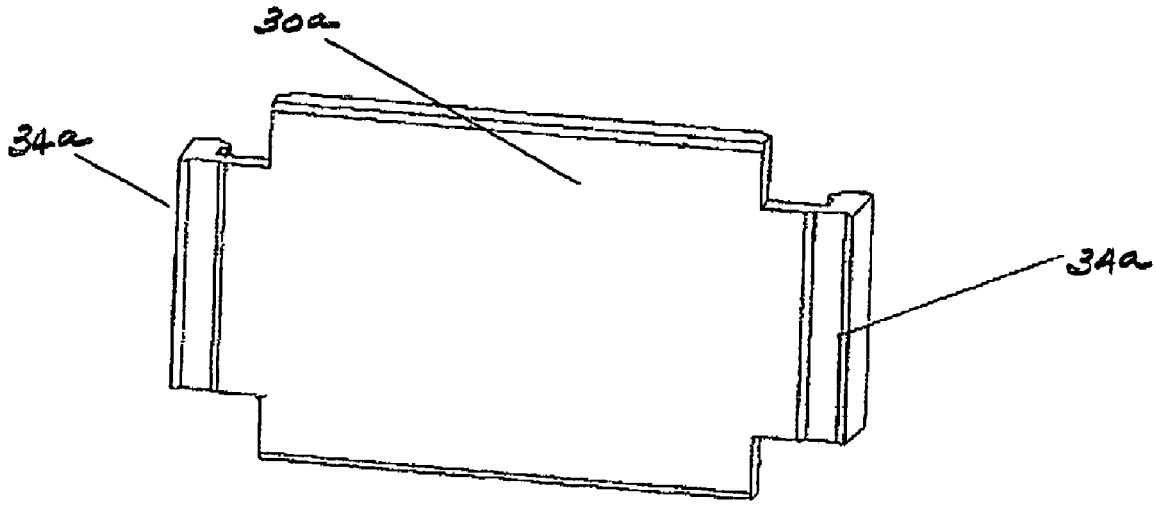
FIG. 12 is a perspective view of the front of the removable panel of the tool holder of the second embodiment.
Figure 13:
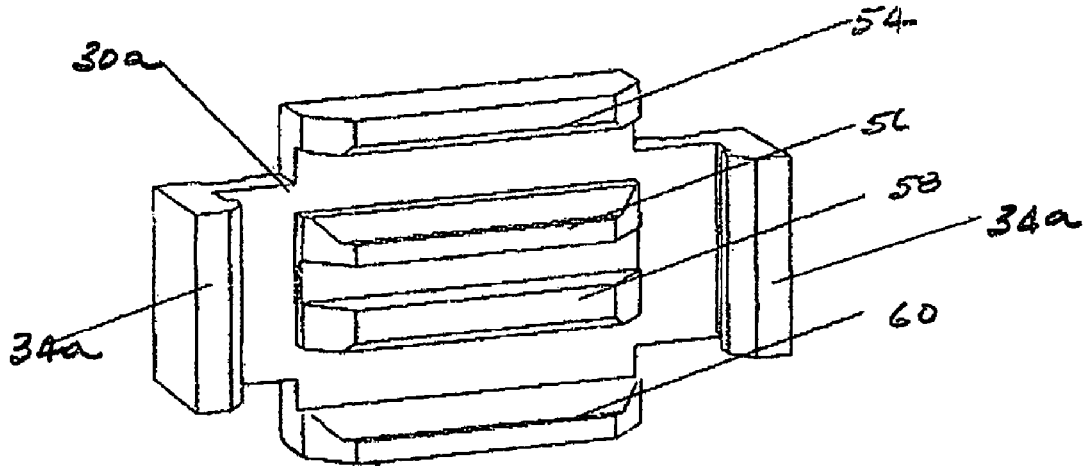
FIG. 13 is a perspective view of the rear of the removable panel of FIG. 12.

Referring now to FIGS. 7-13 there is shown another embodiment of the invention in which parts corresponding to those of the first embodiment are shown using the same reference numerals followed by the letter 'a'. The structure of the bracket 12*a* and the connecting member 16*a* are substantially identical to the corresponding bracket 12 and connecting member 16 of the first embodiment, except that the length of the connecting member 16*a* is shown as shorter than the connecting member 16. However, the tool holder 14*a* at the lower end of the connecting member 16*a* is substantially different so as to accommodate different tools such as screw drivers and the like. As in the first embodiment, the two corresponding side panels 28*a* each contain snap orifices 32*a* to accommodate the snap buttons 34*a* of the removable panel 30*a*. As best seen in FIG. 11, the inside walls of the side panels 28*a* have vertically spaced-apart projections 42, 44, 46 and 48 that extend inwardly to provide between them slots to receive one or more rubber rings 50 each having a center hole 52 (FIGS. 9 and 10). In addition, the back or inside wall of the removable panel 30*a* has vertically spaced-apart projections 54, 56, 20 58 and 60 (FIG. 13) that correspond to the projections 42, 44, 46 and 48 to form slots for the support of the rubber ring or rings 50. FIG. 8 shows two rings 50 in place in these slots. Also, formed in the inside surface of the back wall of the tool holder 4, are two slots 62 and 64 (FIG. 11) that form part of the rabbeted joint with the rings 50. To best accommodate the rings 50 in these slots, each ring has a lower chamfered circumferential surface 66 and an upper circumferential projection 68.

With the foregoing described structure of the second embodiment, tools like small screwdrivers can be positioned in the center hole 52 of a rubber ring and held in place for display. Other similar tools can be so positioned and held.

Thus, the embodiments of the invention provide a versatile hanger for holding and displaying a variety of tools. The bracket 12 can accommodate the different sizes and embodiments of the tool holder 14 and 14*a*. Because of the unique snap fastening arrangement that connects the standardized bracket 12 to the connecting members 16 or 16*a*, changes to different tool holders 14 and 14*a* can be quickly and easily made thereby facilitating the storage and display of a wide variety of different tools in an organized and aesthetically pleasing manner. When the hangers 10 are to be stored or shipped, the bracket 12 can be folding downwardly behind the connecting member 16 and tool holder 14, or the bracket 12 can be easily detached and stored separately.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A device for holding and displaying hand tools, said device comprising:

a bracket having an upper end and a lower end and having a snap orifice near the lower end and a slot near the upper end for hanging the device when displaying a tool and;

a connecting member having an upper end and a lower end and a front and rear surface; and a tool holder at the lower end of the connecting member for holding a tool; the connecting member having a first snap fastener near its upper end engageable with the snap orifice of the bracket for removably connecting the bracket to the tool holder;

whereby different types and sizes of tool holders can be connected to the bracket, depending upon the tool being displayed;

wherein the first snap fastener near the upper end of the connecting member projects outwardly from the rear surface of the connecting member and there are two vertically spaced-apart pairs of second snap fasteners projecting outwardly from the rear surface of the connecting member at a position below the first snap fastener, the lower end of the bracket having a rounded shaft that is engageable between the pairs of the second snap fasteners to provide for pivot movement of the bracket relative to the connecting member, whereby wherein the bracket can be pivoted downwardly against the rear surface of the connecting member when the first snap fastener is disengaged from the snap orifice in the bracket.

2. The device of claim 1 in which the lower end of the connecting member has a plurality of openings to accommodate removable bendable ties for holding a tool in the tool holder.

3. The device of claim 1 in which the tool holder comprises a pair of horizontally spaced apart side panels extending outwardly from the lower end of the connecting member, and a front panel removably combined with the side panels to form a space for holding a tool.

4. The device of claim of claim 3 in which the tool holder has a divider block extending outwardly from the front surface of the connecting member between the side panels of the toll holder.

5. The device of claim 3 in which the side panels each have a snap orifice and the front panel has a snap fastener engageable with the snap orifice of the side panels.

6. The device of claim 3 in which each of the side panels have a plurality of vertically spaced-apart projections extending inwardly into the space between the side panels, and a flexible tool support ring is positioned between and supported by the projections, the support ring having a central opening adapted to receive and support a tool.

7. The device of claim 6 in which the front panel has a plurality of projections extending inwardly into the space between the side panels, the projections of the front panel mating with the projections on the side panels to provide additional support for the tool support ring.

8. The device of claim 7 in which at least one slot is formed in the front surface of the connecting member at its lower end to provide additional support for the tool support ring.

9. The device of claim 8 in which the tool support ring is made of a rubber compound.

10. The device of claim 1 in which the tool holder comprises a pair of horizontally spaced apart side panels extending outwardly from the lower end of the connecting member, and a front panel removably combined with the side panels to form a space for holding a tool.

11. The device of claim of claim 10 in which the tool holder has a divider block extending outwardly from the front surface of the connecting member between the side panels of the tool holder.

12. The device of claim 10 in which the side panels each have a snap orifice and the front panel has a snap fastener engageable with the snap orifice of the side panels.

13. The device of claim 10 in which each of the side panels have a plurality of vertically spaced-apart projections extending inwardly into the space between the side panels, and a flexible tool support ring is positioned between and supported by the projections, the support ring having a central opening adapted to receive and support a tool.

14. The device of claim 13 in which the front panel has a plurality of projections extending inwardly into the space between the side panels, the projections of the front panel mating with the projections on the side panels to provide additional support for the tool support ring.

15. The device of claim 14 in which at least one slot is formed in the front surface of the connecting member at its lower end to provide additional support for the tool support ring.

16. The device of claim 15 in which the tool support ring is made of a rubber compound.

* * * * *